US008347471B2

(12) United States Patent
Wang

(10) Patent No.: US 8,347,471 B2
(45) Date of Patent: Jan. 8, 2013

(54) RATCHET PLIERS FOR SNAP RING

(76) Inventor: Yuan Yu Wang, Taichung (TW)

( * ) Notice: Subject to any disclaimer, the term of this patent is extended or adjusted under 35 U.S.C. 154(b) by 244 days.

(21) Appl. No.: 12/987,149

(22) Filed: Jan. 9, 2011

(65) Prior Publication Data

US 2012/0174361 A1 Jul. 12, 2012

(51) Int. Cl.
*B25B 27/30* (2006.01)

(52) U.S. Cl. ..... 29/229; 29/268; 29/238; 29/267; 29/278; 29/270

(58) Field of Classification Search ..... 29/229, 29/225, 228, 238, 244, 268, 267, 261, 270, 29/278
See application file for complete search history.

(56) References Cited

U.S. PATENT DOCUMENTS 3,041,712 A * 7/1962 Wurzel ..... 29/229
3,564,694 A * 2/1971 Millheiser ..... 29/229
4,158,302 A * 6/1979 O'Loughlin ..... 72/409.16
4,280,265 A * 7/1981 Murphy ..... 29/229
5,515,587 A * 5/1996 Pool ..... 29/229
6,378,403 B1 * 4/2002 Bates et al. ..... 81/302
2012/0174361 A1 * 7/2012 Wang ..... 29/229

* cited by examiner

*Primary Examiner* — Lee D Wilson

(57) ABSTRACT

Snap ring pliers include first and second pivotal levers wherein the first lever has a first jaw and a first handle and the second lever has a second jaw and a second handle; a biasing member interconnecting the handles; and a ratchet mechanism comprising a curved ratchet rack having one end secured to an end of the second handle and the other end proximate an end of the first handle; a sliding member secured to the end of the first handle and comprising a projection at one end, and a channel with the other end of the ratchet rack moveably disposed therein; a lock member having one end pivotably secured to the projection and comprising a protrusion at the other end; and a pawl member on the lock member and having one end secured onto the projection, the pawl member comprising a lock hole with the protrusion locked therein.

3 Claims, 11 Drawing Sheets

RATCHET PLIERS FOR SNAP RING

BACKGROUND OF THE INVENTION

1. Field of Invention

The invention relates to pliers and more particularly to ratchet pliers for either internal type or external type of snap ring.

2. Description of Related Art

Snap rings (or called retaining rings) are shaped as C and are either "internal" or "external". The internal type of snap ring is used to retain elements (e.g., bearings or shafts) within a bore. In order to install the ring it is contracted to allow it to pass into the bore, and then allowed to expand for engagement with an internal groove formed around the bore. The external type of snap ring is used to retain elements (e.g., bearings, gears or pulleys) on shafts. An external snap ring normally engages an annular groove formed in a shaft to inhibit axial movement of an element mounted on the shaft. An external snap ring is installed by expanding the ring until its internal diameter is greater than the shaft diameter. The tools used for installing and removing internal and external snap rings are well known in the art.

For example, there are types of snap ring pliers specifically for either an internal snap ring or an external snap ring. There is also a type of universal snap ring pliers which are adapted to manipulate either an internal snap ring or an external snap ring. There is another type of snap ring pliers having adjustable jaws.

There is one drawback common to all of above typical snap ring pliers. In detail, the installation or removal of a snap ring requires an individual to hold the snap ring firmly by holding the snap ring pliers with the hand. An unintentional loosening of the holding due to carelessness or sudden exhaustion prior to finishing the work may cause the snap ring to fall. To the worse, the stored elastic energy of the flexibly deformed snap ring may cause the snap ring to fly, hit and hurt the individual who holds the snap ring pliers. This is unsafe. The reason for the drawback is that there is no mechanism (e.g., ratchet) provided by the snap ring pliers for step-by-step or precisely maintaining the relative position of the pliers and the snap ring in the holding operation. Thus, the need for improvement still exists.

SUMMARY OF THE INVENTION

It is therefore one object of the invention to provide snap ring pliers comprising first and second levers pivotably secured together wherein the first lever comprises a first jaw and a first handle, and the second lever comprises a second jaw and a second handle; a biasing member interconnecting the first and second handles; and a ratchet mechanism comprising a curved ratchet rack having one end fixedly secured to an open end of the second handle and the other end disposed proximate to an open end of the first handle, the ratchet rack comprising a series of teeth; a sliding member fixedly secured to the open end of the first handle and comprising a projection at one end, and a channel with the other end of the ratchet rack moveably disposed therein; a lock member having one end pivotably secured to the projection and comprising a protrusion at the other end; and a pawl member disposed on the lock member and having one end secured onto the projection, the pawl member comprising an elastic finger at the other end, and an intermediate lock hole with the protrusion partially disposed therein to be locked; whereby pivoting the lock member in a first direction will disengage the protrusion from the lock hole to be unlocked, and cause the finger fall into a depression between two adjacent ones of the teeth to be positioned; whereby moving the sliding member along the ratchet rack until being stopped will cause the finger fall into the depression between two adjacent ones of the teeth to be positioned; and whereby pivoting the lock member in a second direction opposing the first direction will cause the protrusion to enter the lock hole to be locked and disengage the finger from the teeth.

The above and other objects, features and advantages of the invention will become apparent from the following detailed description taken with the accompanying drawings.

DETAILED DESCRIPTION OF THE INVENTION

Figure 1:
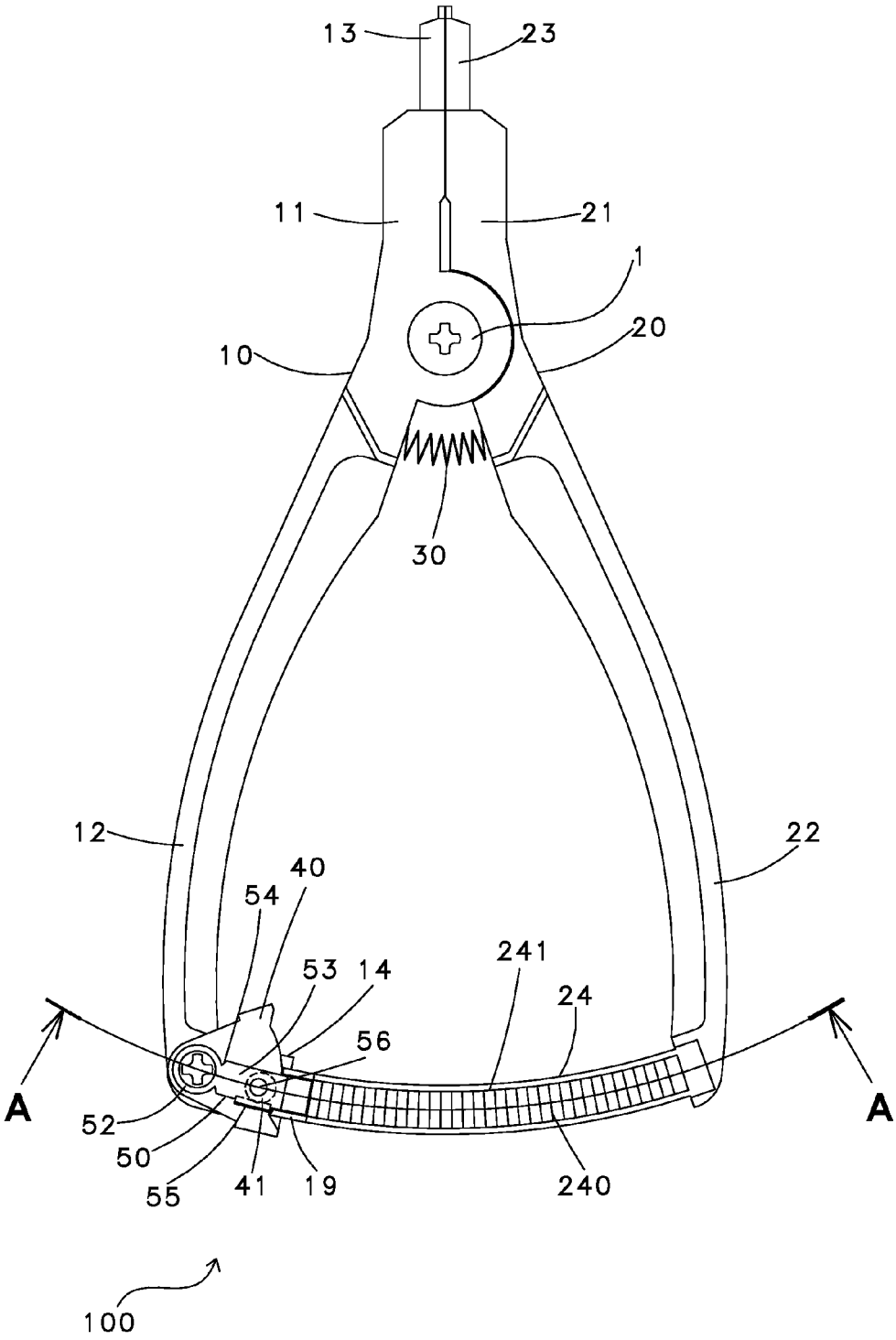
FIG. 1 is a side elevation of ratchet pliers for external type of snap ring according to a first preferred embodiment of the invention, the pliers being locked in an inoperative position with the handle ends being separated to a maximum distance.
Figure 2:
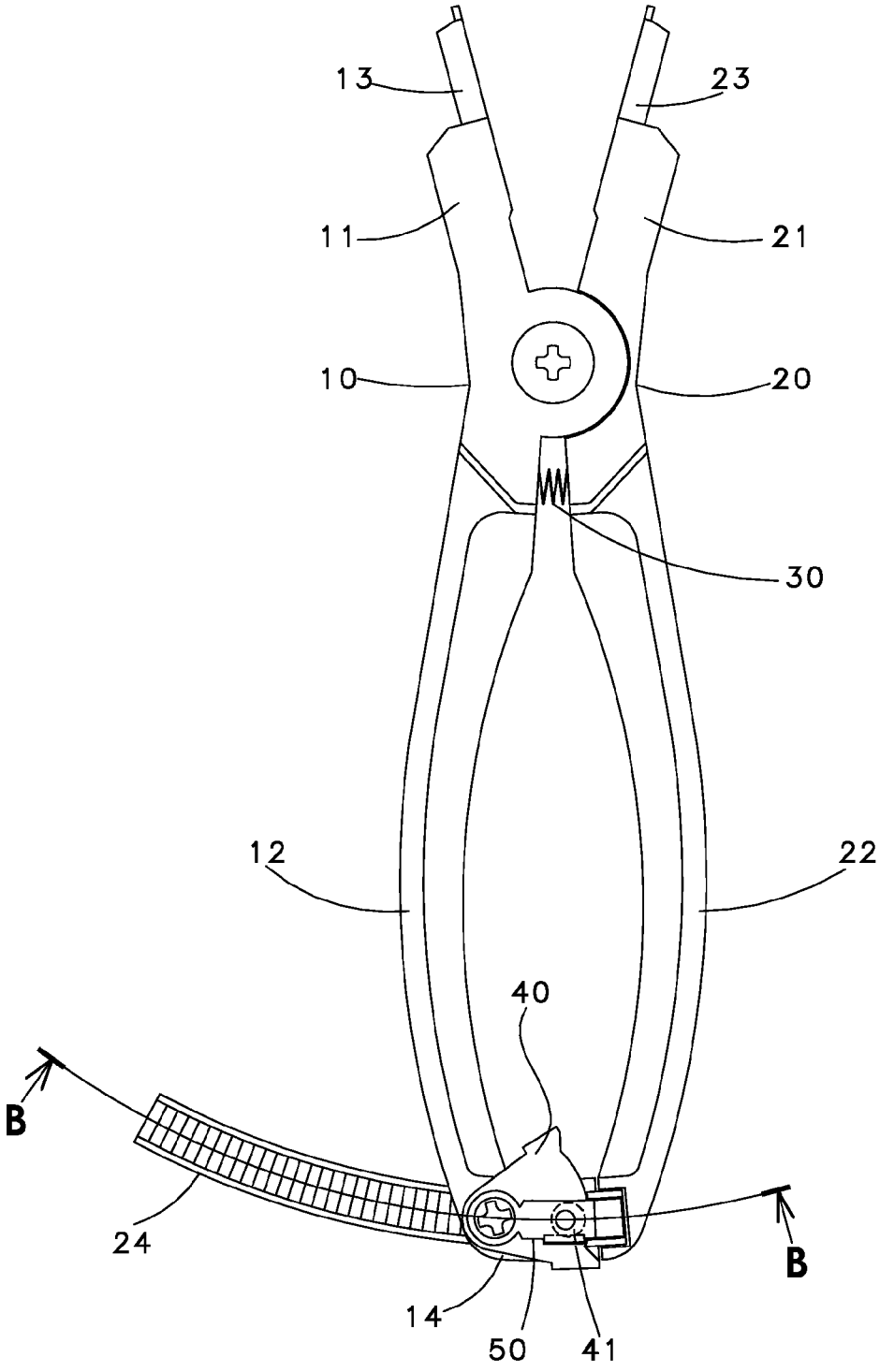
FIG. 2 is a view similar to FIG. 1 where the handles ends being pivoted to be proximate each other as the handles being pushed toward each other by the force exerted by the hand.
Figure 3:
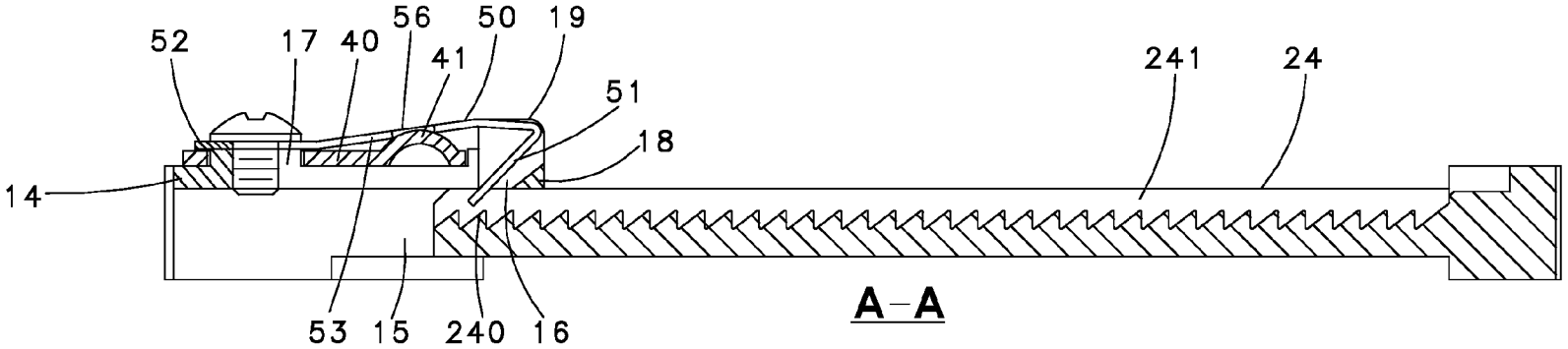
FIG. 3 is a sectional view taken along line A-A of FIG. 1.
Figure 4:
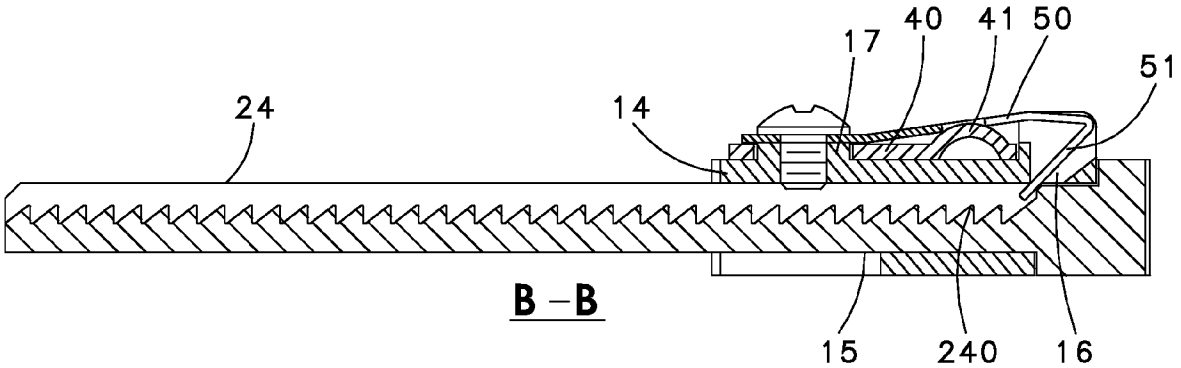
FIG. 4 is a sectional view taken along line B-B of FIG. 2.
Figure 5:
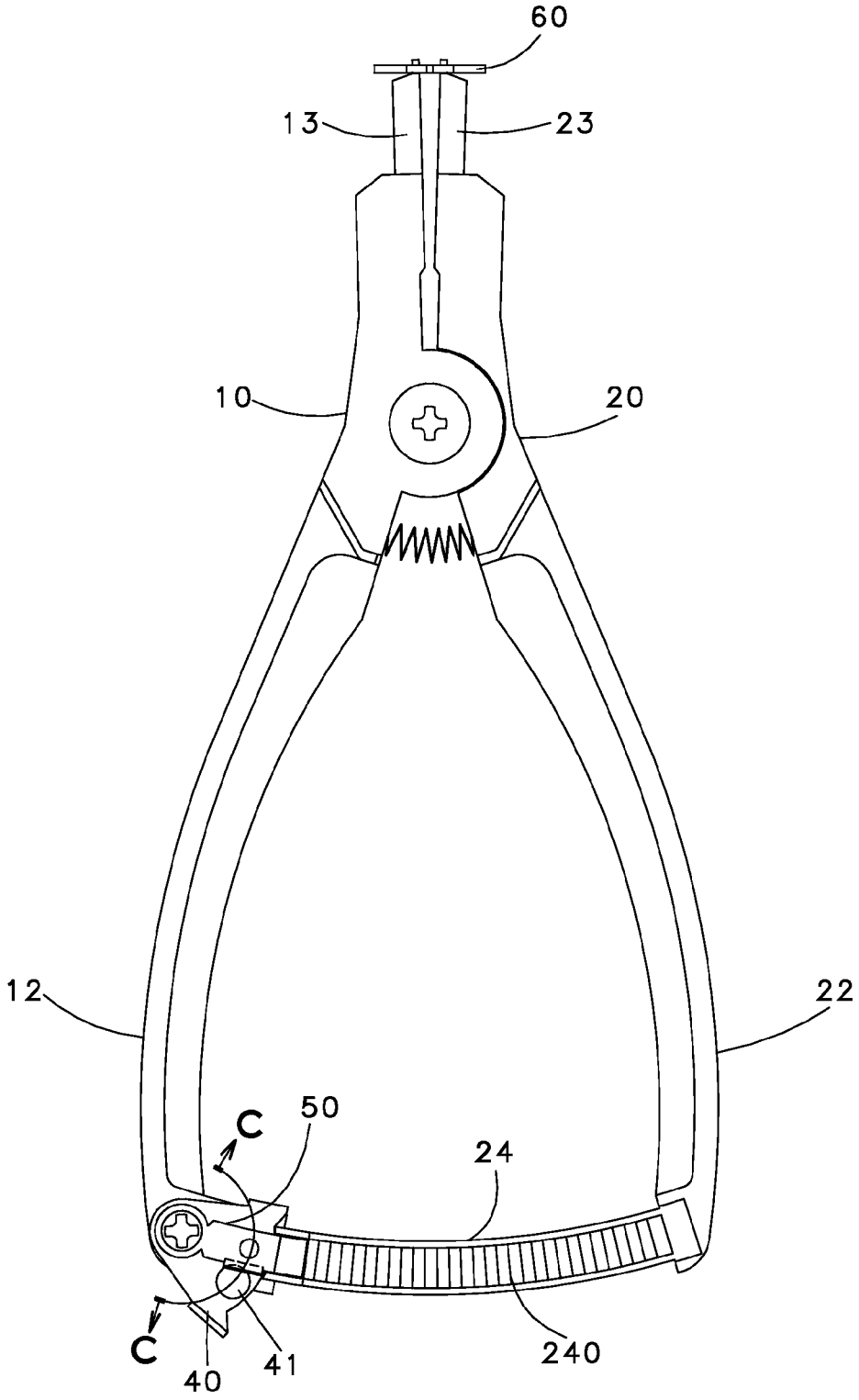
FIG. 5 is a view similar to FIG. 1 with a snap ring being gripped by the gripping members and the lock member being pivoted to unlock the sliding member.
Figure 6:
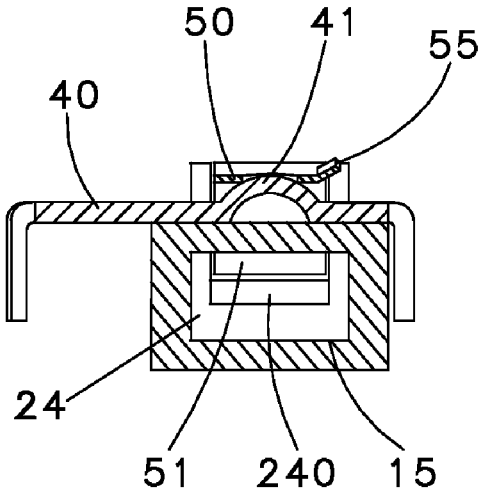
FIG. 6 is a sectional view showing the locked state of the lock member in the inoperative position of the pliers.
Figure 7:
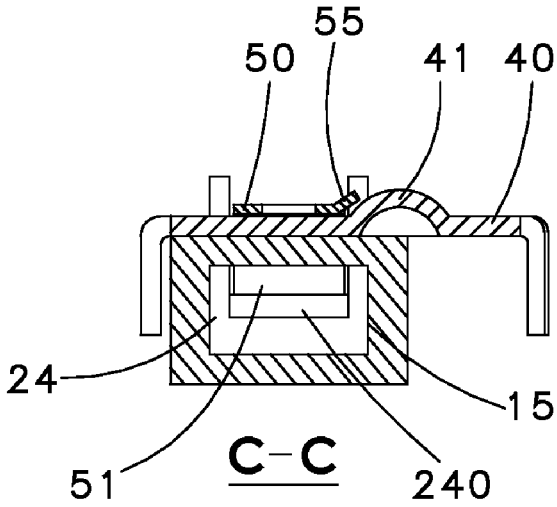
FIG. 7 is a sectional view taken along line C-C of FIG. 5 showing the unlocked state of the lock member where the sliding member is ready to ride along the ratchet rack in an operative position of the pliers.
Figure 8:
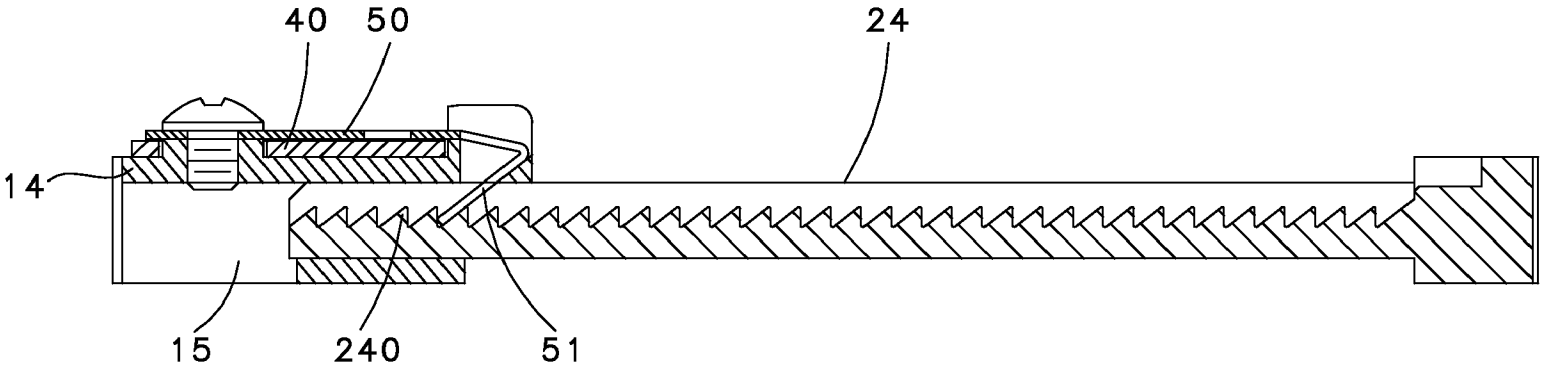
FIG. 8 is a longitudinal sectional view of the sliding member and the ratchet rack where the sliding member is unlocked.
Figure 9:
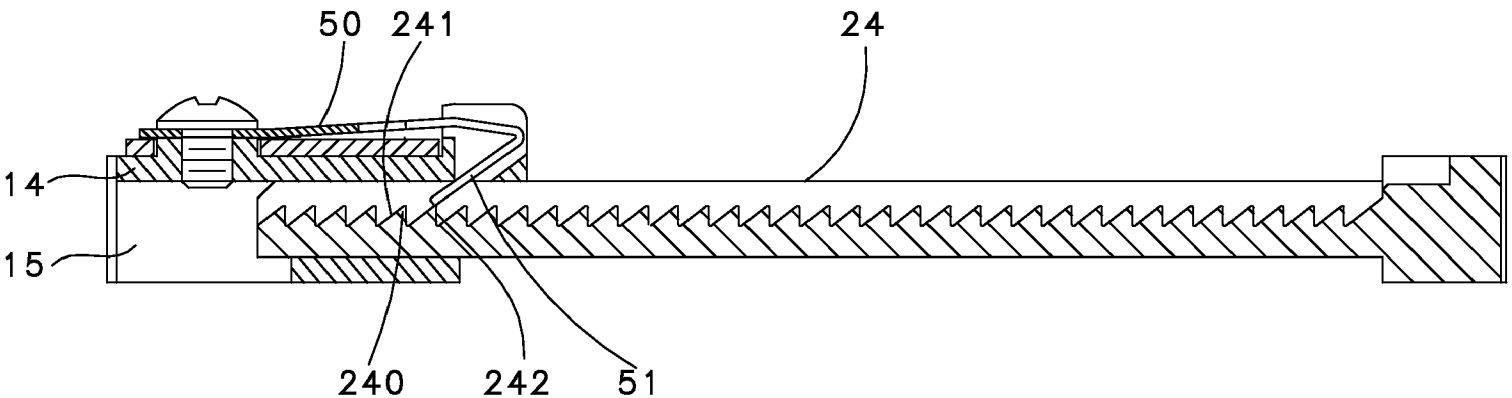
FIG. 9 is a view similar to FIG. 8 where the ratchet rack is moved leftward with the sliding member riding thereon by passing the teeth.
Figure 10:
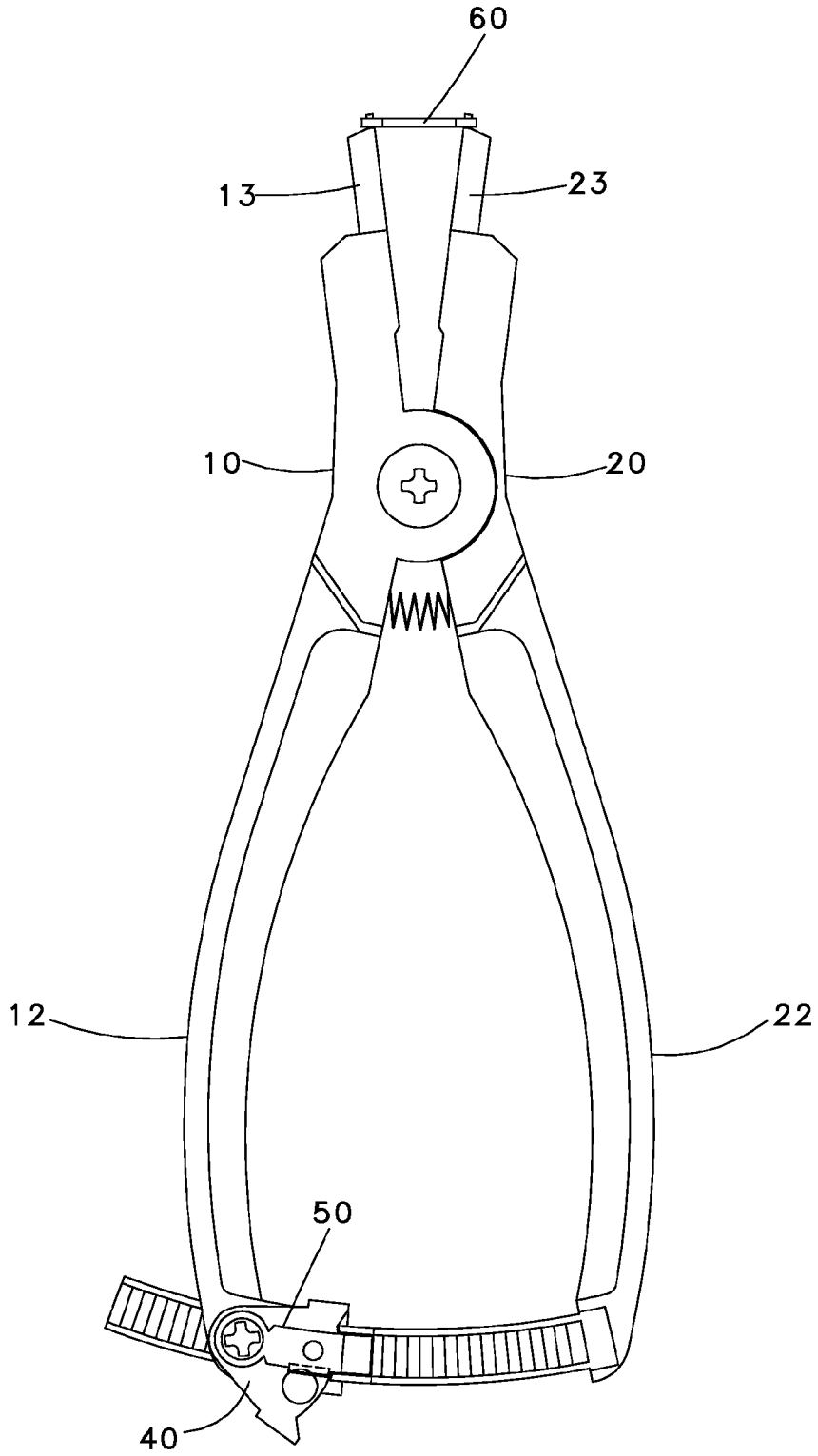
FIG. 10 is a view similar to FIG. 5 showing the snap ring being expanded during the movement of the sliding member along the ratchet rack.
Figure 11:
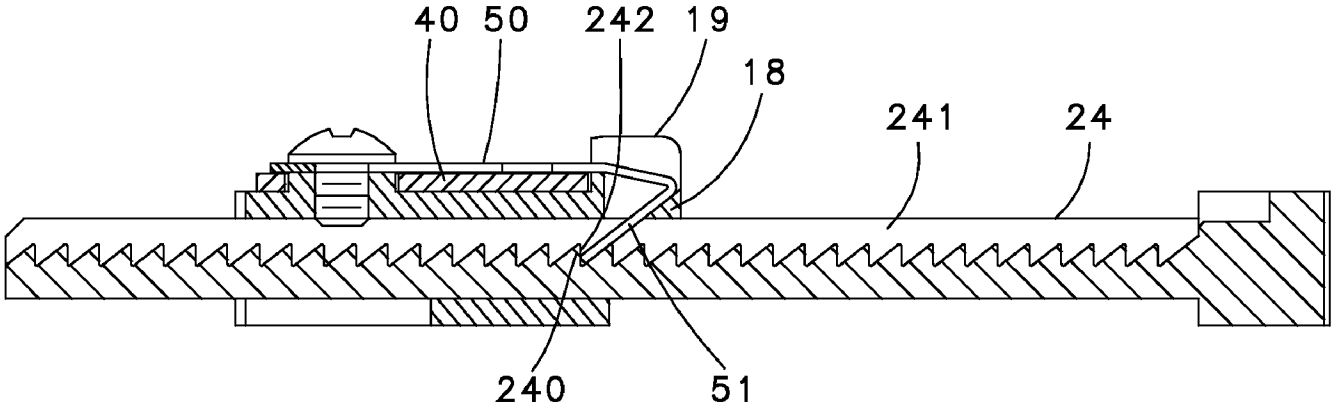
FIG. 11 is a view similar to FIG. 8 showing the finger being locked by the depression between the teeth at the end of the expanding operation of the snap ring.

Referring to FIGS. 1 to 14, ratchet pliers in accordance with a first preferred embodiment of the invention comprises the following components as discussed in detail below.

A pair of first and second levers 10, 20 are pivotably secured together at a fulcrum 1. The first lever 10 comprises a first jaw 11 and a first handle 12. The second lever 20 comprises a second jaw 21 and a second handle 22. A torsion spring 30 adjacent to the fulcrum 1 is interconnected the handles 12, 22. A first gripping member 13 is projected out of an open end of the first jaw 11. A second gripping member 23 is projected out of an open end of the second jaw 21. The gripping members 13, 23 are either engaged in an inoperative position of the pliers due to the expansion of the spring 30 and the provision of a ratchet mechanism 100 (discussed below) or disengaged for holding an object (e.g., an external type of snap ring 60) firmly in an operative position of the pliers.

The ratchet mechanism 100 as the subject of the invention comprises the following components as discussed in detail below.

A curved ratchet rack 24 has one end fixedly secured to an open end of the second handle 22 and the other end disposed proximate to an open end of the first handle 12. A sliding member 14 is fixedly secured to an open end of the first handle 12 and adapted to ride on the ratchet rack 24 as detailed below.

The sliding member 14 comprises an internal channel 15 therethrough with the other end of the ratchet rack 24 disposed therein in an inoperative position of the pliers. The ratchet rack 24 can move through the channel 15 when the pliers operate. A projection 17 is provided on the surface at one end of the sliding member 14. A roof 19 is provided at the other end of the sliding member 14 and a slope 18 is provided under the roof 19. An opening 16 is provided between and defined by the roof 19 and slope 18.

A lock member 40 is pivotably provided on the surface of the sliding member 14 by having one end frictionally, pivotably put on the projection 17 and the other end proximate to the opening 16. The lock member 40 comprises a protrusion 41 at the other end. A pawl member 50 has one end 52 secured onto the projection 17 by means of a fastener and the other end bent as a finger 51 disposed through the opening 16 and urged against the slope 18. The pawl member 50 is disposed on the lock member 40 and further comprises an intermediate lock hole 56 with the protrusion 41 partially disposed therein to be locked.

As shown in FIGS. 5 to 11, after the gripping members 13, 23 gripping a snap ring 60, a user may clockwise pivot the lock member 40 to cause the protrusion 41 to clear the lock hole 56 (i.e., unlocked). Tip of the elastic finger 51 thus falls into the depression 242 between two adjacent teeth 240 (of right-angled triangular longitudinal section) of the ratchet rack 24 to be temporarily locked (i.e., positioned). Next, the hand of the user may exert force to grip the handles 12, 22 so as to flexibly deform (i.e., expand) the snap ring 60. At the same time, the sliding member 14 moves rightward with the finger 51 easily sliding up and over the sloped edges 241 of the teeth 240 as the finger 51 passes the tip of each tooth 240 (see FIG. 9). The user may stop exerting force on the handles 12, 22 when the snap ring 60 is firmly held by the gripping members 13, 23. The Tip of the elastic finger 51 thus immediately falls into the depression 242 again to be temporarily locked (i.e., positioned). At this position, the snap ring 60 is prevented from dropping out of the gripping members 13, 23.

Figure 13:
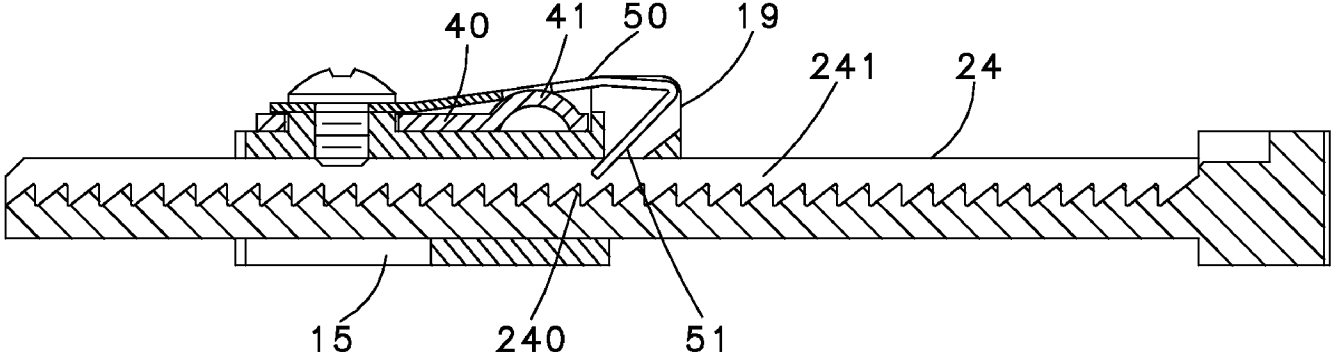
FIG. 13 is a view similar to FIG. 3 showing the sliding member being locked again by the lock member as a step for releasing the snap ring.
Figure 12:
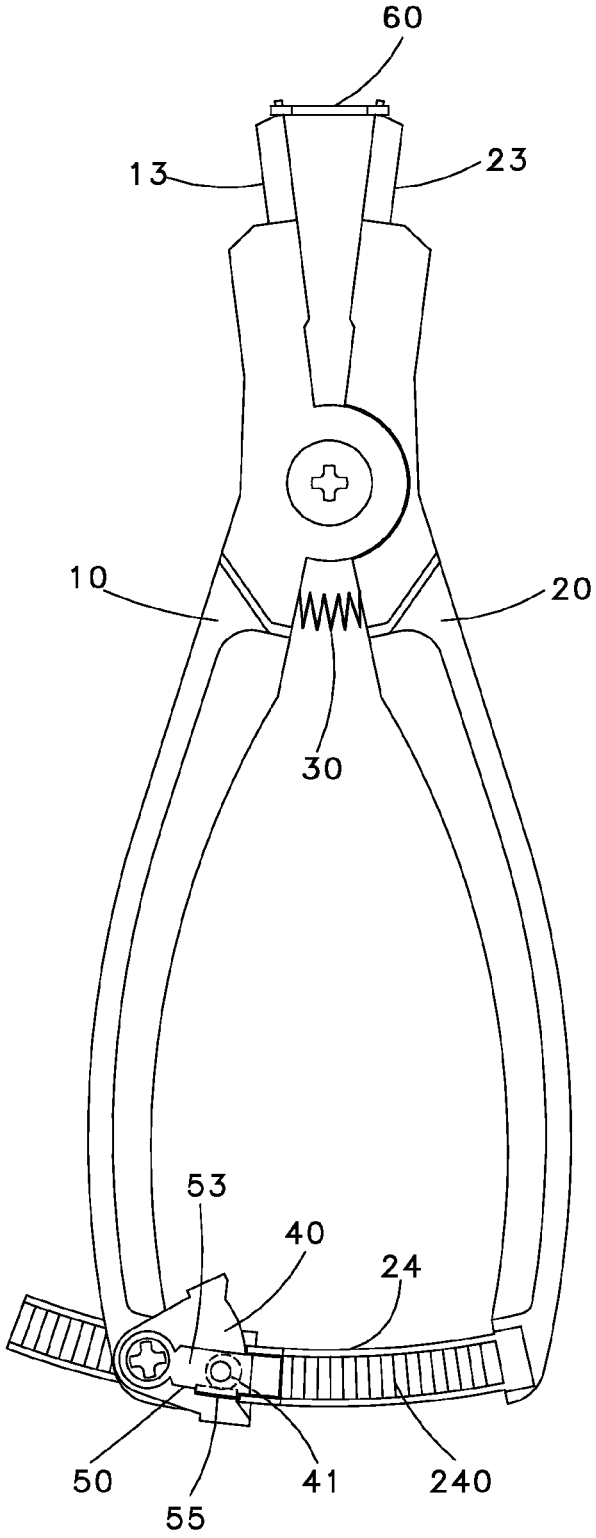
FIG. 12 is a view similar to FIG. 10 showing the pliers in a state corresponding to FIG. 11.
Figure 14:
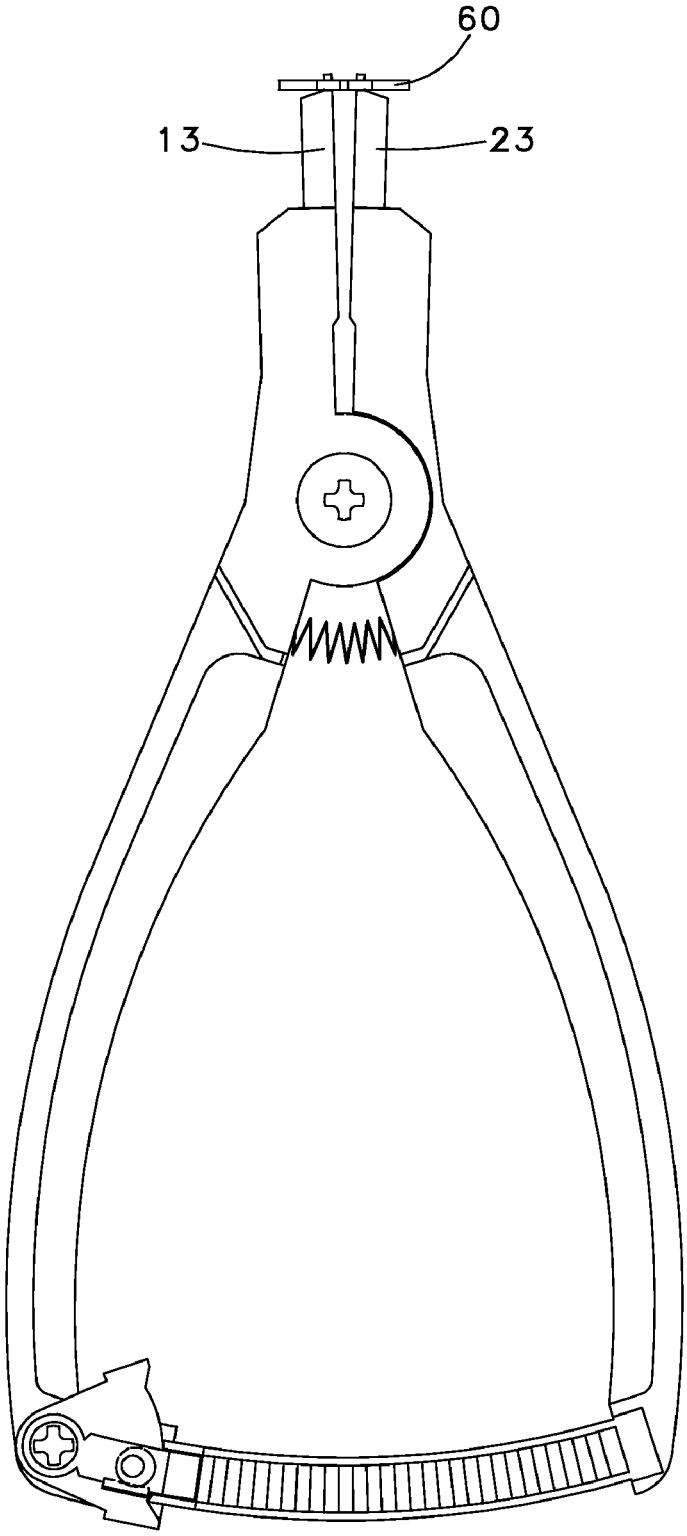
FIG. 14 is a view similar to FIG. 5 showing the locked sliding member and the contracted snap ring.

As shown in FIGS. 12 to 14, for releasing the snap ring 60 after finishing the working, the user may counterclockwise pivot the lock member 40 to cause the protrusion 41 to partially enter the lock hole 56 to be locked. Also, tip of the elastic finger 51 clears the tooth 240 to be unlocked. Thus, the user may slide the sliding member 14 along the ratchet rack 24 until being stopped at the open end of the first handle 12. Hence, the snap ring 60 is only loosely held by the gripping members 13, 23. Thereafter, the user may release the snap ring 60.

Figure 15:
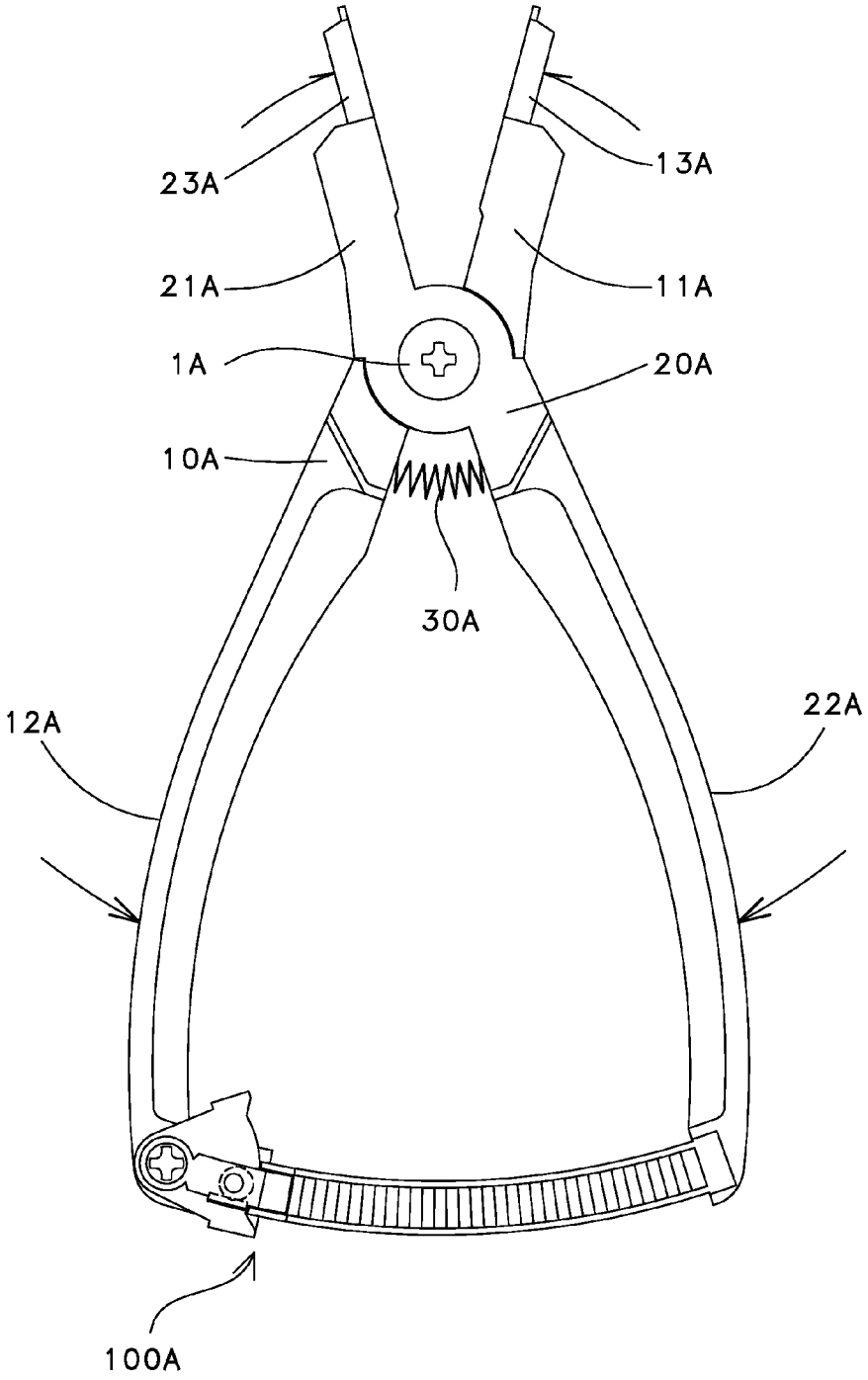
FIG. 15 is a side elevation of ratchet pliers for internal type of snap ring according to a second preferred embodiment of the invention, the pliers being locked in an inoperative position with the handle ends being separated to a maximum distance.

Referring to FIG. 15, ratchet pliers in accordance with a second preferred embodiment of the invention is shown. The second preferred embodiment of the ratchet pliers comprises a ratchet mechanism 100A, a pair of first and second levers 10A, 20A pivotably secured together at a fulcrum 1A, the first lever 10A including a first jaw 11A and a first handle 12A, the second lever 20A including a second jaw 21A and a second handle 22A, a torsion spring 30A adjacent to the fulcrum 1A being interconnected the handles 12A, 22A, a first gripping member 13A projected out of an open end of the first jaw 11A, and a second gripping member 23A projected out of an open end of the second jaw 21A.

The ratchet mechanism 100A is constructed and operated the same as the ratchet mechanism 100 of the first preferred embodiment. The gripping members 13A, 23A are disengaged in an inoperative position of the pliers due to the expansion of the spring 30 and the provision of the ratchet mechanism 100A or engaged for holding an object (e.g., an internal type of snap ring) firmly in an operative position of the pliers.

While the invention has been described in terms of preferred embodiments, those skilled in the art will recognize that the invention can be practiced with modifications within the spirit and scope of the appended claims.

What is claimed is:

1. Snap ring pliers comprising:

first and second levers pivotably secured together wherein the first lever comprises a first jaw and a first handle, and the second lever comprises a second jaw and a second handle;

a biasing member interconnecting the first and second handles; and a ratchet mechanism comprising:

a curved ratchet rack having one end fixedly secured to an open end of the second handle and the other end disposed proximate to an open end of the first handle, the ratchet rack comprising a series of teeth;

a sliding member fixedly secured to the open end of the first handle and comprising a projection at one end, and a channel with the other end of the ratchet rack moveably disposed therein;

a lock member having one end pivotably secured to the projection and comprising a protrusion at the other end; and a pawl member disposed on the lock member and having one end secured onto the projection, the pawl member comprising an elastic finger at the other end, and an intermediate lock hole with the protrusion partially disposed therein to be locked;

whereby pivoting the lock member in a first direction will disengage the protrusion from the lock hole to be unlocked, and cause the finger fall into a depression between two adjacent ones of the teeth to be positioned;

whereby moving the channel of the sliding member along the ratchet rack until being stopped will cause the finger fall into the depression between two adjacent ones of the teeth to be positioned; and whereby pivoting the lock member in a second direction opposing the first direction will cause the protrusion to enter the lock hole to be locked and disengage the finger from the teeth.

2. The snap ring pliers of claim 1, wherein the sliding member further comprising a roof at the other end and a slope under the roof so as to define an opening between the roof and the slope.

3. The snap ring pliers of claim 2, wherein the finger is disposed in the opening and urged against the slope when the protrusion is locked by the lock hole.

* * * * *